US006726425B1

(12) United States Patent
Schmidknoz

(10) Patent No.: US 6,726,425 B1
(45) Date of Patent: Apr. 27, 2004

(54) METHOD AND DEVICE FOR ADHESIVE BINDING A SET OF SHEETS OF BOOKS, BOOK BLOCKS, BOOKLETS AND THE LIKE

(75) Inventor: Peter Schmidknoz, Nittenau (DE)

(73) Assignee: Bielomatik L.O.S. GmbH, Nittenau (DE)

( * ) Notice: Subject to any disclaimer, the term of this patent is extended or adjusted under 35 U.S.C. 154(b) by 0 days.

(21) Appl. No.: 09/926,538

(22) PCT Filed: May 16, 2000

(86) PCT No.: PCT/DE00/01521

§ 371 (c)(1),
(2), (4) Date: Mar. 6, 2002

(87) PCT Pub. No.: WO00/69651

PCT Pub. Date: Nov. 23, 2000

(30) Foreign Application Priority Data

May 17, 1999 (DE) ..... 199 22 100

(51) Int. Cl.[7] ..... B42C 9/00

(52) U.S. Cl. ..... 412/8; 156/384; 156/908; 270/58.08; 412/1; 412/9; 412/37

(58) Field of Search ..... 412/1, 6, 8, 9, 412/18, 33, 37, 901, 902; 270/52.18, 58.08; 156/216, 475, 908, 384

(56) References Cited

U.S. PATENT DOCUMENTS 3,788,921 A * 1/1974 Polit et al. ..... 156/216
4,310,576 A * 1/1982 Hesselmann et al. ..... 427/428
4,511,297 A * 4/1985 Wilson et al. ..... 412/8
4,715,758 A * 12/1987 Stobb ..... 412/8
4,828,645 A 5/1989 Van Bortel
4,925,354 A * 5/1990 Cote ..... 412/8
5,246,325 A * 9/1993 Morishige et al. ..... 412/11
6,042,318 A * 3/2000 Ferrante ..... 412/8

FOREIGN PATENT DOCUMENTS

| | | |
|---|---|---|
| DE | 566354 | 12/1932 |
| FR | 999414 | 1/1952 |
| FR | 2189215 | 1/1974 |
| JP | 8-244381 | 9/1996 |
| WO | WO 00/69651 | * 11/2000 |

* cited by examiner

*Primary Examiner*—Monica S. Carter
(74) *Attorney, Agent, or Firm*—Hoffman, Wasson & Gitler

(57) ABSTRACT

In order to adhesively bind a set of sheets of book blocks, booklets and the like, the inner book (6) is inserted in a clamping device (7–11) with the back facing downward and received by a holding device that can be moved horizontally and perpendicularly in relation to the plane of the block. The adhesive is applied onto the backs of the blocks from the bottom by a press on device by means of an adhesive pad (17). The adhesive pad is impinged upon by the press on device in such a manner that the back of the book forms a set of sheets on one side and then on the other side by exerting pressure while adhesive is imultaneously applied on the back of the book forming the set of sheets (FIG. 1).

22 Claims, 6 Drawing Sheets

METHOD AND DEVICE FOR ADHESIVE BINDING A SET OF SHEETS OF BOOKS, BOOK BLOCKS, BOOKLETS AND THE LIKE

FIELD OF THE INVENTION

This invention refers to a method for adhesively binding a set of sheets of books, book blocks, booklets and the like by fastening the book block and applying adhesive to the sheets of the back of the book block.

BACKGROUND OF THE INVENTION

When adhesively binding sheets of book blocks and the like for small series or individual books, the stack of sheets, such as a book block, is clamped and is manually painted with liquid adhesive at its back. This method is time consuming and the adhesive which is applied from the top flows into the spaces between adjacent sheets so that the edge areas of said sheets become smeared, and so that too much adhesive is wasted.

THE INVENTION

It is an object of this invention to rationalize manual labor of adhesively binding fanned sheets of book blocks, and to substitute it by machine in order to increase the production speed, to reduce the adhesive consumption, and to handle the binding not only at higher speed but also to obtain a by far more stable and durable long term bonding for the bound products. In addition, the adjustment of the width of the back of a book block or the pitch for solid covers which are to be rounded, is to be clearly determined.

The invention proposes a method according to which a book block with it's back downwards is inserted into a clamping device and is clamped as well taken up by a supporting device which by means of an operating device is movable horizontally and rectangularly in view of the plane of the block, the adhesive is applied from below onto the back of the block by means of an adhesive pad, the adhesive pad is arranged within a container which is operated by a press-on device in such a manner that the back of the book block is fanned towards the one and subsequent thereto towards the other side and that simultaneously adhesive material is applied onto the fanned back of the book block, and the press-on device is controlled so that the trough for the adhesive pad performs a tilting/sloping movement.

The product to be bonded by adhesively binding the fanned set of sheets of a book block, which throughout the specification will be called the "book block", is clamped in the usual manner so that the individual sheets and the back of the block maintain their poosition relative to each other, which is necessary for the bonding procedure. The clamped book block is firmly fastened and from below a pad soaked with adhesive or an adhesive applying plate is pressed against the back of the block. Subsequent thereto the adhesive pad pressed against the back of the block is moved in a direction rectangular to the plane of the sheets of the block, and at the same time is lifted or tilted on one side so that the back of the block is moved from a horizontal into an inclined, skewed position. Simultaneously, the pad is moved in longitudinal direction. In this manner the individual sheets of the stack are fanned at their back area so that a defined section of small width is released for receiving adhesive material. This type of fulling and massaging effect between the back of the book and the adhesive pad allows that adhesive is applied to a larger, exactly restricted area of the individual sheets within the back area of the block in a controlled manner, and that the surface provided with adhesive is increased as well the effectivity of the adhesive binding is clearly improved.

This method of improved binding by adhesive is performed by machine; clamping and fastening of the book block as well moving the adhesive pad and fanning the back of the block is achieved by a lever system, either by means of machine operated or by manual drive, and can be part of a production line as means for obtaining an automatically operating process of book binding or of a production plant, namely automatically feeding and clamping the book block, hanging of the book block into the block gripping device, opening and closing said gripping device, longitudinal movement, lifting, tilting the adhesive pad, adjusted to the format and the thickness of the book block, and removing the book block subsequent to the binding process as well discharging the completed book block and feeding a new book block.

According to a further embodiment of the forementioned process for binding fanned sheets of the back of a block the invention proposes to handle the book block obtained by said binding process in such a manner that a slip-fold is applied onto the back of the block and onto the lateral sections joining the back. The slip-fold is made from a strip of paper, fabric or the like material with dry adhesive, and is applied under pressure onto the adhesive binder. The edges of the slip-fold are pressed against the lateral sections of the block and are connected with each other by a heating and sealing process. The slip-folds can be applied onto a fabric tape as a carrier individually or are fed automatically so that this method step can be introduced and integrated into an automatically operating book binding system. In case of a machined system the slip-folds can be supplied continuously, cut into the required shape and positioned onto a printing table, lifted and pressed against the finished book block.

Means for performing the above-described method is a manually operated or machine-driven device, which as a unit is integrated into a larger system in order to allow an automatic operation within a production line. The prepared, clamped book block is (manually or automatically) passed into a gripping device with the both-sided clamping bars resting thereon. The gripping device is connected with the frame of the machine and is adjustable to different thicknesses of blocks. Operating said adjustment means is achirvrd fot example by levers manually or motor driven. The back of the book block extending downwardly and freely from the gripping device is arranged above an adhesive applying device, which comprises a trough and an adhesive pad arranged therein. The trough is movable in height, movable in length and tiltable in view of the adhesive pad so that by corresponding driving means (manually or by motor) a horizontal movement, a vertical movement and a tilting movement in both directions canl be obtained. The course of movement is controlled by connecting link means the route of which can be transformed by controlling drums onto the trough and the adhesive pad arranged in said trough.

Connected with the trough is an adhesive source which supplies the adhesive pad with sufficient adhesive continously. The adhesive is a wet dispersion adhesive which is received by the felt pad within the trough so that the surface of the pad facing the underside or the back of the book block, is continuously available. The felt pad is sealed by a covering foil or a covering plate as long as the device is not operating so that the device is always ready for operation, and adhesive at the upper side of the pad is available if the covering foil or the covering plate is removed.

The forementioned device for adhesive binding of fanned sheets of a book block or the like is supplemented by a further device, by means of which a slip-fold in the form of a fabric strip, for eample from linen, together with adhesive, is mechanically applied onto the book block or the like mechanically. Such slip-fold can be formed as a continuous carton folder. The book block bonded by adhesively binding is inserted into a gripping device in a clamped condition. Below the gripping device a pressure plate is arranged, which is adjustable in height, and is covered by a textile or similar fabric web, which is silicone-coated at its upper side. Onto this web an adhesive strip made of fabric-type material is applied associated to the back of the block; the upper side of the adhesive strip facing the back of the block is provided with a dry adhesive layer. The adhesive strip is folded around the two edges of the back of the block so that it covers the lower section of the two opposite lateral walls of the book block.

These two lateral sections are in contact with a heater bar which heats the adhesive of the adhesive strip, and by a sintering-type process results in a firm bonding effect with the adhesive at the back of the block as well a firm bonding with the two opposite cover sides of the book block. The slip-fold forms a strong connection between the slip-fold and the book block as soon as the heating process has been completed. It is important that the wet dispersion adhesive for the adhesive binding of the back of the book and the dry dispersion adhesive of the slip-fold are matched in view of each other in order to obtain an optimum bonding and a sintering effect between both. The above described device for applying a slip-fold onto book blocks, brochures, continuous carton folders or other stacks of sheet material requires a supplemental device in addition to the device for adhesive binding so that both devices can be units within a book binding installation or a production line, and as well the adhesive binding as the slip-fold binding can be designed in such a manner that an automatic operation mode and an automatic supply of the binding elements and the matching of the operation stepscan be achieved.

Instead of performing the driving movement for the adhesive applying device by means of a mechanical connecting link control, said driving movement can be performed with a movable container carriage mechanically, pneumatically, hydraulically or electrically by means of correspondingly controlled driving cylinders fffor achieving a lifting movement.

Preferably, the adhesive container is moved on rollers and is driven up an inclined plane formed as a tilting lever or a rocker, which plane is tilted at the lifting end around a tilting axis so that the adhesive container moves downwardly along the tilting lever and back again into the starting position. Subsequent thereto, the tilting lever or rocker is automatically tilted back into the starting position by spring means and the adhesive container in the starting position is moved to the opposite side beyond the tilting lever and subsequent thereto upwards the inclined plane of the tilting lever at the opposite side so that the above described operation cycle is repeated. On said opposite side the adhesive pad can be driven into a parking position in which the trough by means of a cover is sealed automatically by a cover so that the adhesive material-during the parking time will not dry out. In this manner the adhesive within the adhesive pad cannot dry out, and the adhesive pad is ready for operation at any time.

This embodiment is designed for manually or mechanically controlled operation. For an automatic, for example pneumatic operation, basically the same carriage or container can be supported on a scissor's grid arrangement and moves on rollers guided in tracks so that the relative movement in view of the back of the book block can be performed, whwn adhesive is applied. For applying adhesive the adhesive pad is lifted under the book block and is pressed against the book block, whereby the back of the book block is taken along, bent over, fanned and adhesive is massaged in it. At the turning point of the fanning step the container together with the adhesive pad is lowered again and is driven back to the center. The same cycle of operations is performed at the opposite side. The lifting movement can be performed pneumatically or motor-driven, the forward movement is preferably motor-driven. Cylinders are hingedly connected with the container receiving the adhesive pad which cylinders perform a tilting movement of the adhesive pad when the container is lifted so that the adhesive pad rests flat against the book block being fanned, and so that adhesive is taken up in an optimum manner.

With this mode of driving movement the adhesive pad within the trough is pressed against the back of the book, as well upwardly as laterally. With such lateral movement the stack of paper is compressed at the position the guiding rollers revert their direction of motion. Taking up adhesive at this location of compression is restrained so that adhesive is no longer applied correctly. In order to avoid this disadvantage the movement of the adhesive trough can be provided with the rollers at both sides of a pivot lever, and during this pivot movement adhesive is transformed to and massaged into the back of the book.

With the method and the device according to the subject invention an adhesive bonding for books, book blocks, brochures, but also carton folders is obtained in an extremely simple and inexpensive manner, which results in a high degree of durability and stability of the products bound in this manner which is superior to conventional adhesive binding in view of stability, durability and costs.

BRIEF DESCRIPTION OF THE DRAWINGS

The invention will be described by way of example with reference to the drawings.

DESCRIPTION OF EMBODIMENTS OF THE INVENTION

Figure 1:
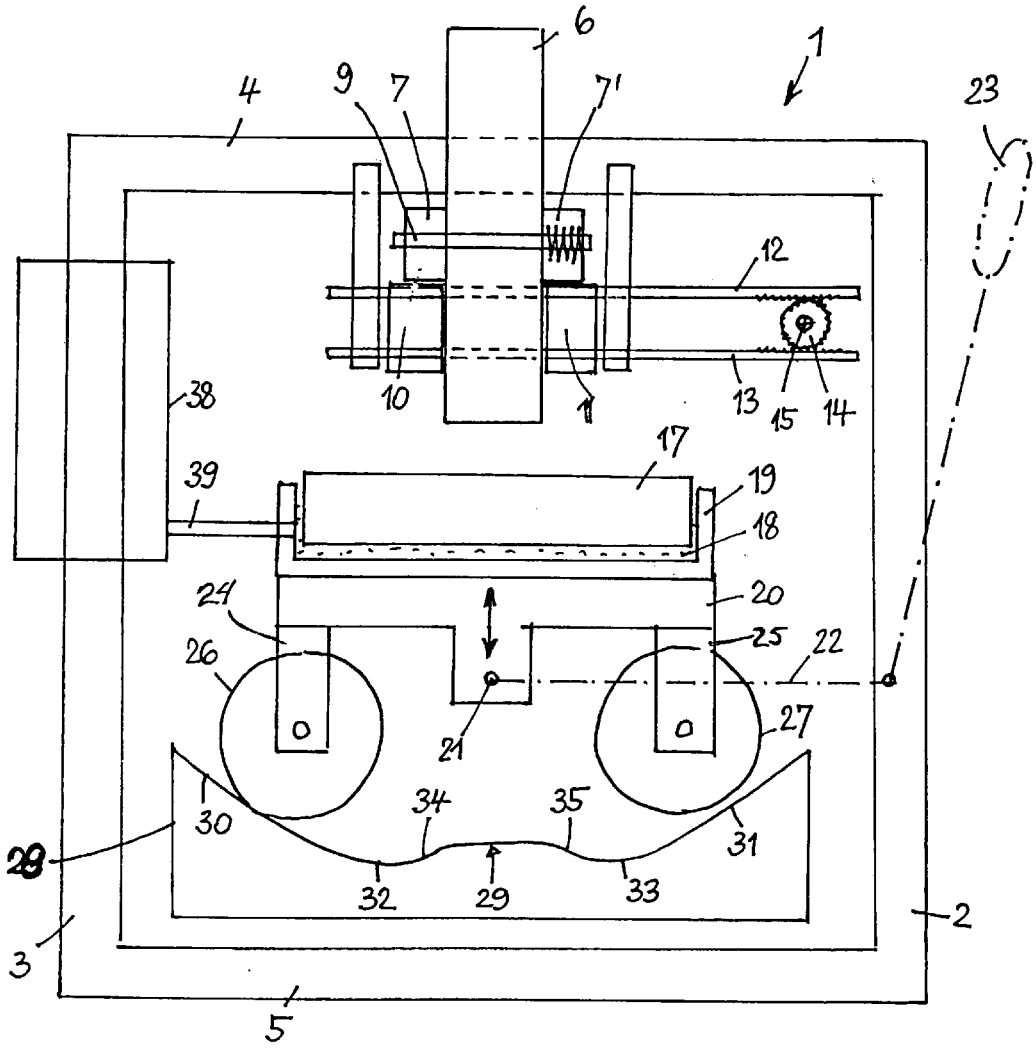
FIG. 1 shows a schematic representation of a lateral view of an adhesive binding device according to the invention.
Figure 2:
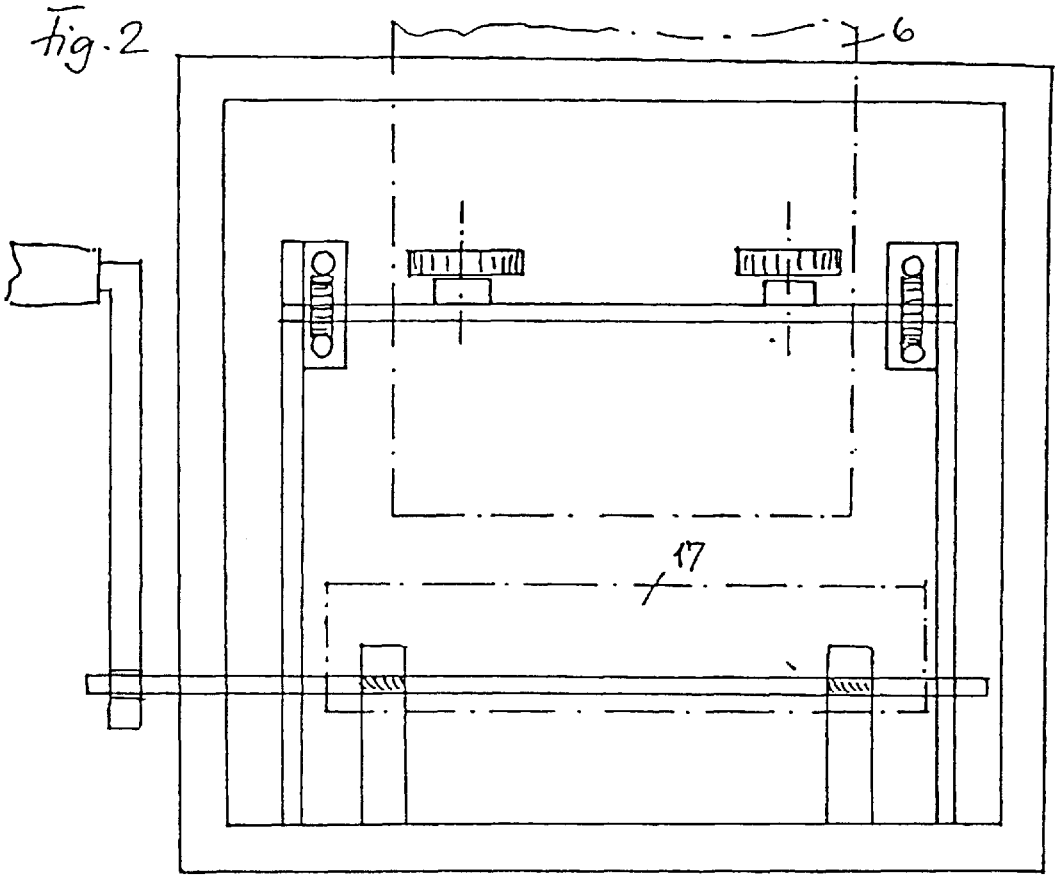
FIG. 2 is a schematic frontal view of the device according to FIG. 1.
Figure 3:
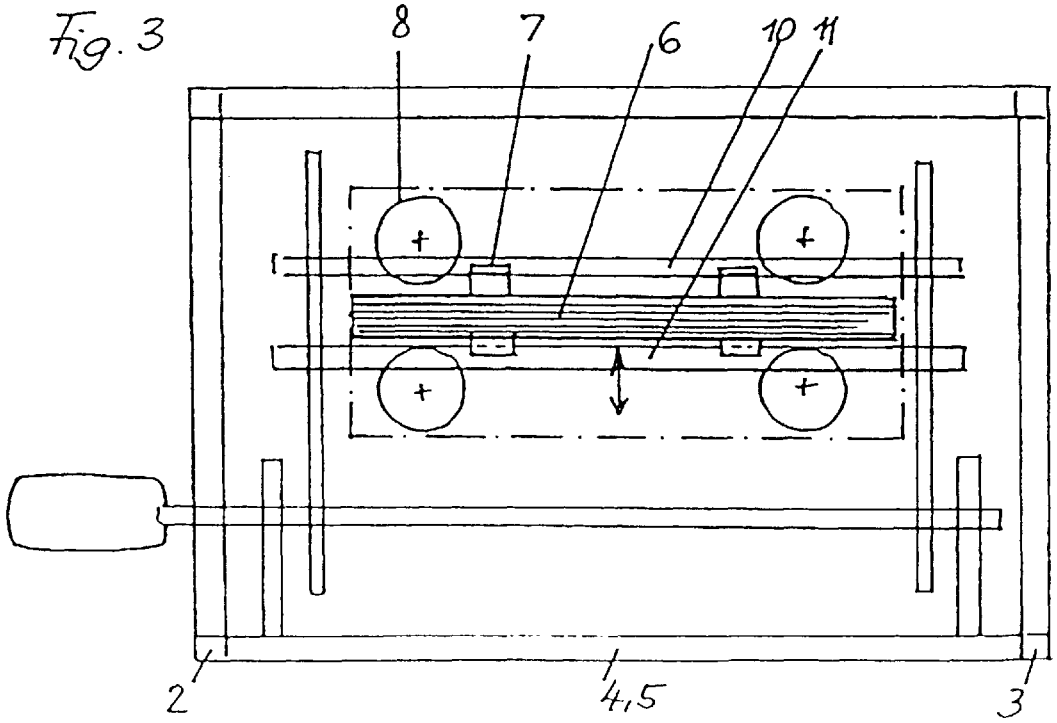
FIG. 3 is a schematic plan view of the device according to FIG. 1.

A square frame 1 with a casing comprises front and rear vertical beams 2, 3 as well upper and lower horizontal longitudinal beams 4, 5. On the upper side of the casing a recess for introducing a book block 6 is provided which is supported by clamping bars 7, 8 for holding the book block. The clamping bars are hold in position at both sides by means of supporting bolts 9 with locking means. With frame 1 or the upper longitudinal beams 4 bars 10, 11 are fastened parallel to the plane of the book block which support the clamping bars 7, 8, and which are adjustable to the thickness of the book block 6. This adjustment is achieved by adjusting rods 12, 13 with driving pinion 14 and drive 15, which can be operated by hand or by motor. The book block can be insertedinto the gripping device manually or mechanically, preferably in an automatically operating sastem.

Below the gripping device 10, 11 and the book block 6 an adhesive applying device 16 is arranged, within which an adhesive pad 17 is positioned in a trough 19 receiving the adhesive supply 18. The trough 19 is mounted with a carrier 20 on which a hinge 21 is formed from which levers 22 are connected to an operating device 23. The operating device 23 can be a lever manually operated and supported on the frame, and a mechanical drive. The carrier 20 for the trough 19 has mounting flanges 24, 25 which are supports for guide rollers 26, 27. Said guide rollers move along a track 28 of a connecting link 29 formed at both sides of the frame. The track 28 along which the guide rollers 26, 27 are passed by operating the levers 22 comprises inclined outwardly ascending sections 30, 31 of the track, horizontal sections 32, 33 and inclined, inwardly ascending sections 34, 35 of the track. The inclined sections 34, 35 determine the vertical stroke of the adhesive pad 17, whereby in this area the pad is firmly pressed against the back 6 of the book block, the horizontal sections 32, 33 determine the area in which the adhesive pad is moved in a horizontal direction relative to the book block, the back of the book block is fanned, and the inclined sections 30, 33 cause the one-sided tilting or sloping locations 36, 37 of the adhesive pad for applying adhesive to the fanned ends of the sheets of the block within the inclined opposite end positions.

38 shows an adhesive supply container which is fastened to the frame 1 of the device and from which an adhesive pipe 39 passes to the trough 19.

Figure 4:
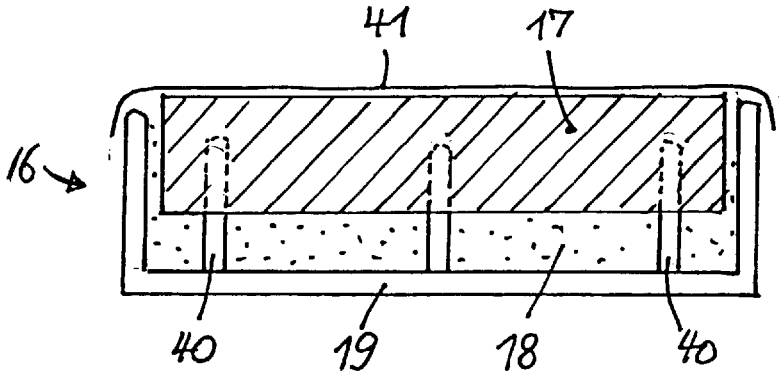
FIG. 4 is a lateral view of the trough with adhesive pad.
Figure 5:
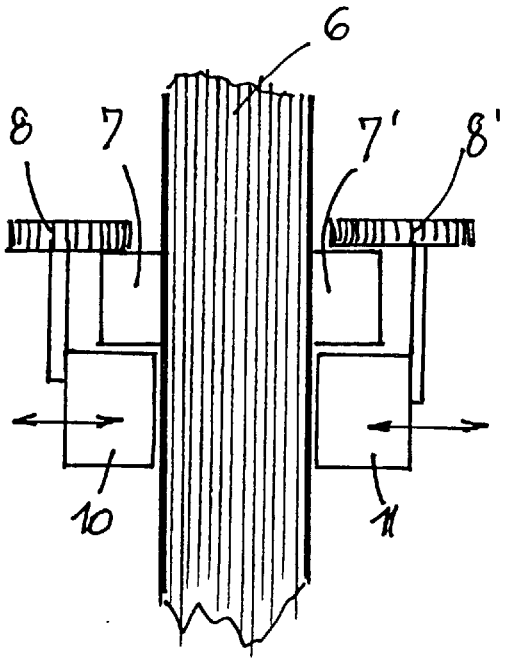
FIG. 5 is a detailed view of the support and the adjustment means for the book block.
Figure 6:
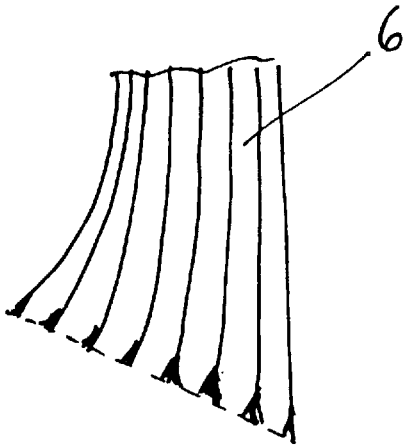
FIG. 6 is a detailed view of the fanning step of the back of a book block.

In FIG. 4 trough 19 is shown in detail. It receives the adhesive pad 17 on strengthening bolts 40 within the trough so that the pad 17 is fixed within the trough 19. Pad 17 immerses into the adhesive supply 18 within the trough and is soaked with adhesive so that the upper side of the pad 17 always is ready for operation. A masking foil 41 is laid over the surface of the pad and the casing, if the pad is not needed so that the adhesive on the surface is not dried by air, but is ready for operation when the foil is withdrawn. Accordingly, it is not necessary to clean the pad after being used.

Figure 7:
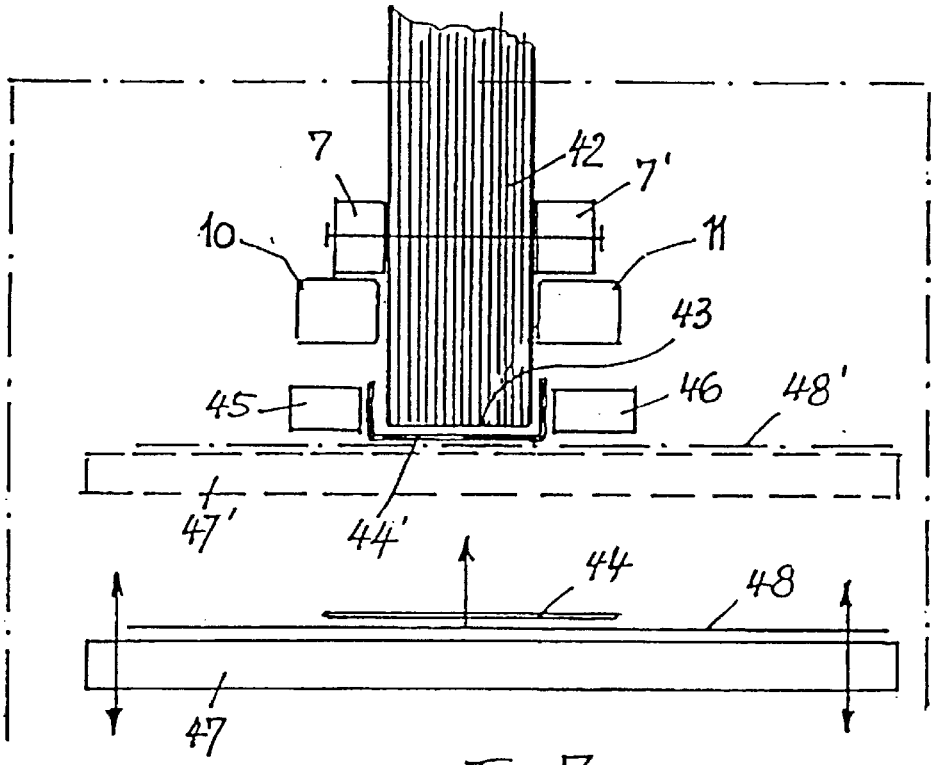
FIG. 7 shows a device for applying a slip-fold onto the book block in schematic laterial view.
Figure 8:
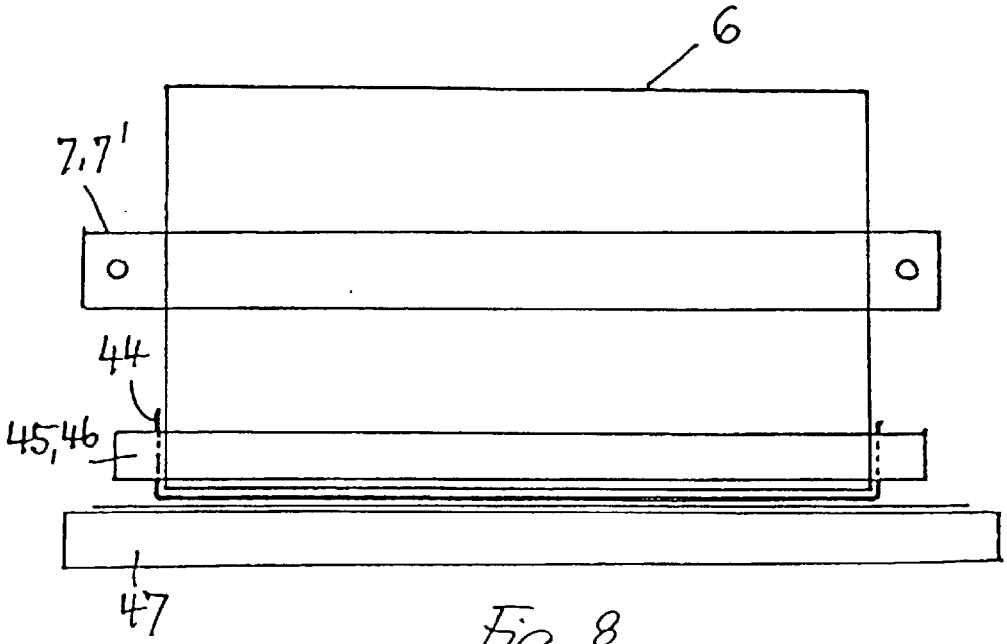
FIG. 8 is a schematic front view of the decive according to FIG. 7.

FIG. 7 shows a device by means of which a slip-fold 44 is applied onto the back of the book block bonded adhesively binding and onto the joining lateral sections of the book block by a separate operation step. A corresponding device analog to FIG. 1 comprises a similar arrangement of a book block with clamping bars 7, 7' and supporting rails 10, 11 for holding the clamping bars. Instead of an adhesive pad with a connecting link control this device has a book block 42 which has been ready bound by adhesively binding at the front side 43 of which a slip-fold 44 is applied, which is provided with an adhesive strip with dry adhesive.

The adhesive for adhesively binding and the dry adhesive on said slip-fold are matched with each other in such a manner that an optimum bonding effectis obtained, when the edge elements of the slip-fold by means of heater bars 45, 46 are pressed against the lower lateral ends of the book block 42 and within the area of the back 43 of the book block the slip-fold is pressed on by means of the pressure plate or table 47 so that the dry adhesive of the slip-fold and the adhesive of the adhesive binding procedure generate a sintering effect with each other which is of extremely high stability. The adhesive strip 44 forming the strip-fold is applied onto a supporting web 48 of textile material with a silicon coating at-the upper side, and is moved alongon the table 47 to the location where the material is applied closely below the back 43 of the book block, and then is pressed against it from the bottom. The slip-folds can be moved automatically towards the binding location automaticallly in order to proceed with a continuous adhesive binding operation, are cut there if required, and are made ready in synchronism with inserting the book block so that also this device can be integrated into an automatically operating binding system.

Figure 10:
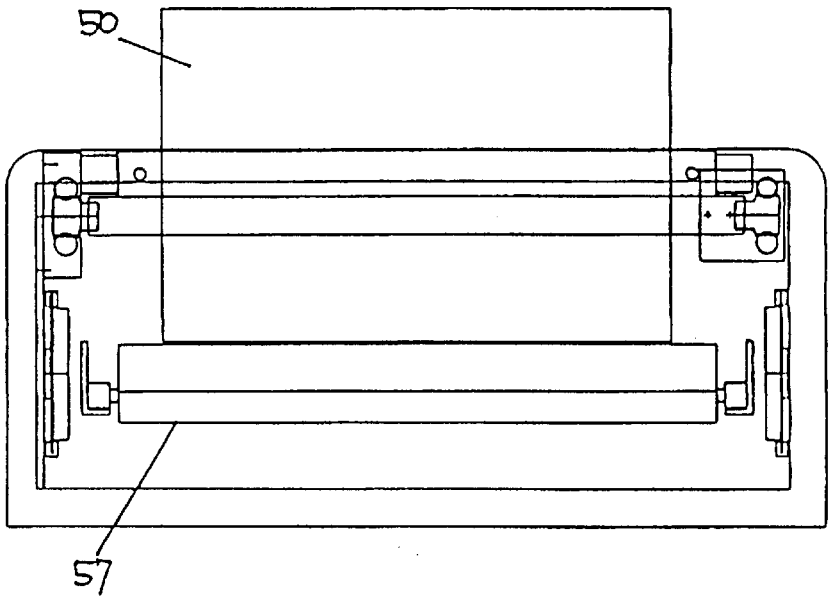
FIG. 10 is a frontal view of the device according to FIG. 9.
Figure 9:
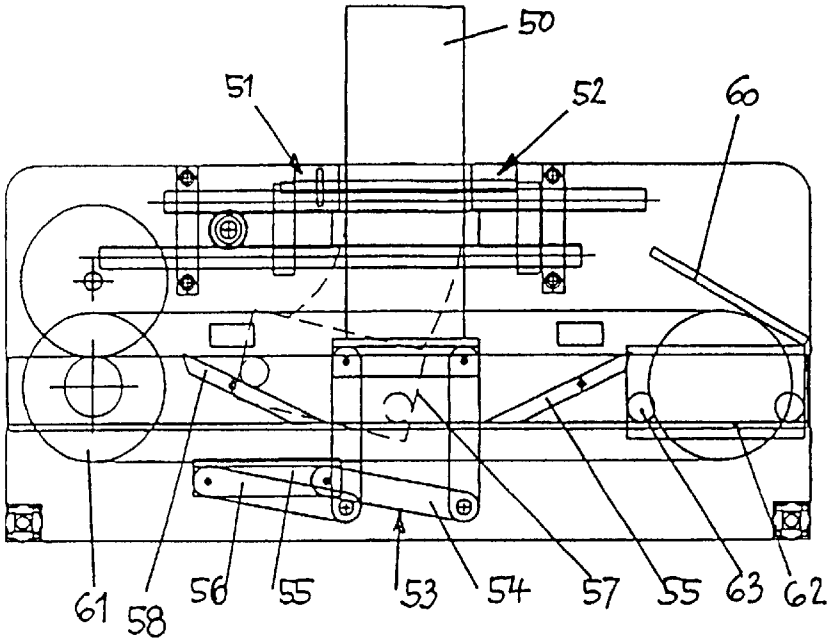
FIG. 9 shows another embodiment of the device according to FIG. 1 in a laterial view.
Figure 13:
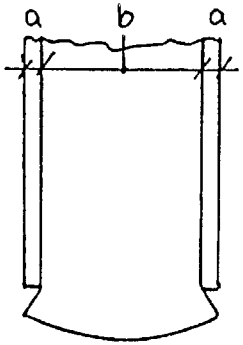
FIG. 13 is a schematic, basic representation for calculating the pitch.

With the embodiment according to FIGS. 9 and 10 book block 50 is clamped by clamping means 51, 52. The back of the book block 50 by means of a press-on device 53 is acted upon from the bottom in order to position and apply the adhesive material; the press on device 53 comprises a parallelogram-type system of levers 54, 55, 56 which subsequent to aligning the book block 50, as shown within the drawings, is flapped or pivoted downwardly.

The carriage 57 which receives the adhesive container with the adhesive pad is shown in FIG. 9 in dotted lines with the book block in a position fanned towards the left side. Along the guide path of the carriage 57 a rocker or tilting lever system is shown to the left and to the right each, along which the carriage 57 moves upwardly. If the carriage 57 has passed the dead center location, the rocker or tilting lever tilts, the carriage moves along the inclined plane downwards, the rockrt or tilting lever by spring force returns into the starting position as soon as the carriage has left the rocker, and the carriage 57 is driven to the opposite side where the cycle is repeated at the rocker or the tilting lever 59 so that the carriage passes the two rockers 58, 59 one after the other within a closed route.

As soon as the carriage has passed the rocker 58, it can be driven into a rest position (right side) in which a lid 60 is closed above the open adhesive container of the carriage 57 so that drying out of the adhesive during the non opersting phases of operation is prevented. 61 shows the drive for the carriage 57, the rollers of carriage 57 are marked with 62, and the rail along which the carriage is moved is marked with 63. With the embodiment according to FIG. 9 the movement of the carriage can be manually or motor driven, depending on the situation of the operation and the size of the device.

Figure 12:
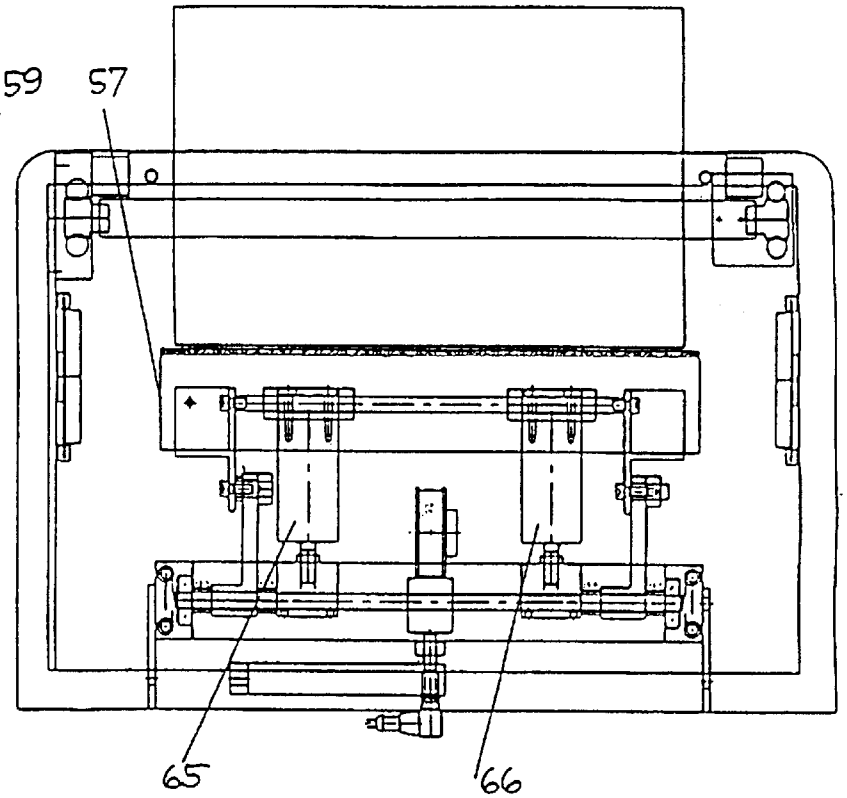
FIG. 12 is a frontal view of the device according to FIG. 11.
Figure 11:
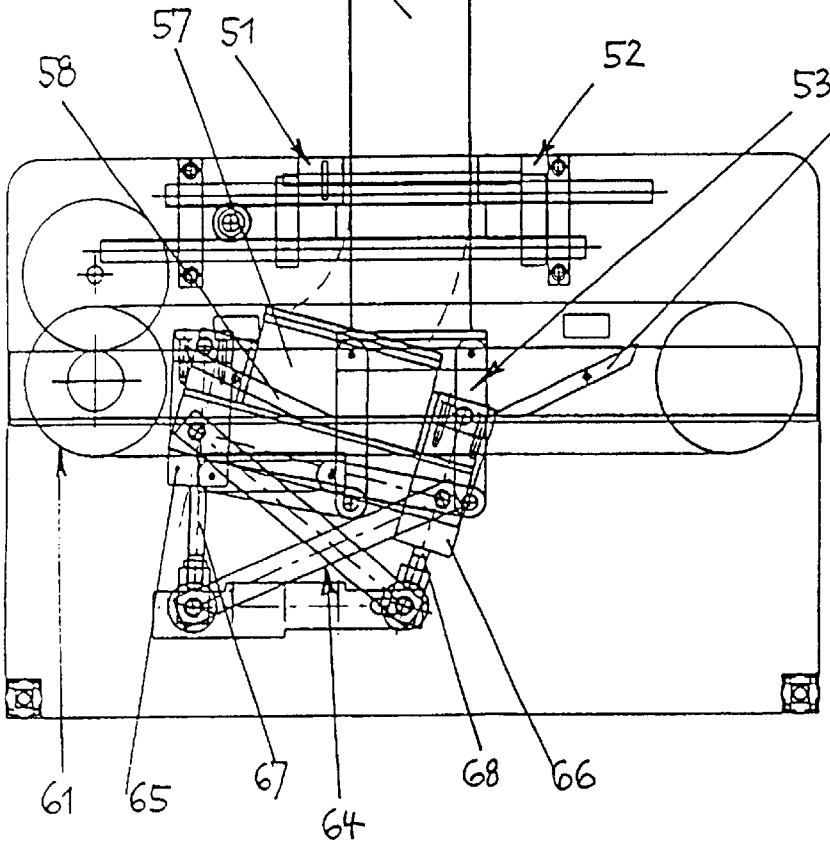
FIG. 11 is another embodiment of the invention in a lateral view.

An automatic operation is obtained with the embodiment shown in FIGS. 11 and 12. The carriage 57 is fastened on a scissors grid arrangement 64 which is adjustable in height by lifting cylinders 65, 66 and lifting rods 67, 68 so that the carriage 57 with the adhesive container is able to carry out a vertical movement simultaneously with a horizontal movement for fanning the back of the book block in order to allow the adhesive to be applied onto the back of the book block.

The arrangement according to FIG. 11 differs from that according to FIG. 9 substantially in that an automatic movement of the adhesive container compared with a manual movement, and thus, an automatic operation can be achieved.

In order to allow an exact production of solid book covers rounded at the back, when slip-folds are to be applied to the back of the book the pitch of the back of the book block can be calculated from the height a of the stack of sheets of the book block and the extra size at the back in the amount of 2×2b (b=thickness of the cardbord) as well an extra measure corresponding to the required roundness of the book betwen 0 and 15%. With a height of the paper stack of say 30 mm and an additional measure at the back of say 2×2=4 mm thickness of the cardbord the total measure will be 34 mm. If an additional measure of 15% corresponding to the roundness of the back of the book is considered which is about 5,1 mm, the width of the back will be 39,1 mm. With this value the required pitch can be adjusted.

What is claimed is:

1. A method for adhesively binding of sheets of book blocks, booklets and the like by fastening the book block and applying adhesive to the back of the book block, comprising the following steps:

a) the book block with the back downwards directed is inserted into a clamping device and is clamped as well received by a supporting device which by means of an operating device is movable horizontally and rectangularly in view of the plane of the block, b) the adhesive is applied from below onto the back of the block by means of an adhesive pad, c) the adhesive pad is arranged within a container which is operated by a press on device in such a manner that the back of the book block is fanned towards the one and subsequent thereto towards the other side, and simultaneously adhesive material is applied onto the fanned back of the book block, and d) the press on device is controlled so that the trough for the adhesive pad performs a tilting/sloping movement.

2. The method according to claim 1, wherein the container with the adhesive pad for carrying out a tilting/sloping movement when pressing the adhesive pad against the back of the book block is moved on inclined planes formed as rockers at both lifting positions one after the other, the relevant rocker is tilted subsequent to exceeding the dead center, and the container is moved back subsequent to arriving the starting plane, the same cycle being repeated at the opposite rocker, and the tilting lever forming the rocker is returned by spring force manually or automatically into the starting position.

3. The method according to claim 2, wherein the container receiving the adhesive pad is moved into a parking position beyond the rockers in which position the container with the adhesive pad is sealed by cover means so that drying out of the adhesive material is prevented.

4. The method according to claims 1, wherein the container receiving the adhesive pad and the guide rollers of the container are coupled with worm fence means, and the container is coupled at both sides with lifting cylinders by means of which the tilting of the container is achieved.

5. The method according to claim 4, wherein the lifting cylinder is operated pneumatically, hydraulically or electrically, and the lifting as well the tilting movement of the container is performed automatically.

6. The method according to claim 1, wherein the press on device causes a fulling or massaging movement onto the adhesive pad and onto the back of the book block.

7. The method according to claim 1, wherein the adhesive material for the adhesive pad is a wet dispersion glue.

8. The method according to claim 1, in which within a separate device or in an auxiliary device a slip-fold is applied onto the back of the completed book block, which slip-fold is provided with dry adhesive, and the lateral sections of the slip-fold are heat-sealed with the block of the book by means of heater bars.

9. The method according to claim 8, wherein the individual slip-folds are transported on a pusher with a desk-type pressure plate to the slip-fold applying station, and the slip-fold is lifted and is pressed onto the back of the book block.

10. The method according to claim 8, wherein a web or cloth is provided upon the pusher with the pressure plate which web or cloth carries the slip-fold.

11. The method according to claim 1, wherein the steps for adhesive bonding, namely inserting the book block, pressing the adhesive pad onto the back of the book block, and massaging the adhesive into the fanned back of the book block resulting from the connecting link control is integrated in an automatically operating book binding system.

12. The method according to claim 11, wherein the step of applying the slip-fold onto the book block by heat sealing by means of heater bars is integrated into an automatically operating book binding system.

13. A system for adhesively binding a set of sheets of book blocks, booklets and the like by means of a clamping device for clamping the book block, and an adhesive applying device for transferring adhesive onto the back of the book, in which the clamped book block being positioned between two support elements which are movable horizontally relative to each other and being fastened in their operating position, wherein a) an adhesive pad is arranged underneath the book block which pad is movable in a direction across the plane of the book block and can be lifted against the back of the book block under pressure, b) driving means are pushing the adhesive pad in a combined horizontal and vertical movement in such a manner that the adhesive pad applies adhesive from below onto the back of the book block, and the pad exerts a fulling resp: massaging movement onto the back of the book block, and c) the vertical movement of the adhesive pad or the pad support is achieved by means effecting a connecting link control, and the horizontal movement of the adhesive pad is achieved by manually or machine-driven levers, wherein a fulling movement of the pad includes a movement extending in a horizontal and an inclined plane, the movement following the course of the track of the connecting link, and the inclined course of movement in both horizontal directions results in a fanning effect on the back of the book block in opposite directions in such a manner that the fanned sheets present an enlarged surface for the adhesive to be applied.

14. The system according to claim 13, wherein the adhesive pad is arranged and fastened within a trough, a continuous adhesive flow is supplied from an adhesive container attached to a frame, and in it's non-operating condition the pad is covered by a foil.

15. The system according to claim 13, wherein the pad material is felt or a similar absorbent material of solid consistency.

16. The system according to claim 13, wherein the clamping bars of the book block are supported on rails within the frame which are movable relative to each other, and are fastened on the rails from top by means of hold down clamps so that a counter pressure is generated against the upwardly acting pressure exerted onto the book block.

17. The system according to claim 14, wherein the adhesive trough is provided with strengthening bolts which receive and position the adhesive pad, an adhesive supply is maintained within the trough keeping the adhesive pad impregnated, and in the non-operating position of the system the adhesive pad is kept uncovered by the cover foil drawn over the trough, and is ready for operation.

18. The device according to claim 13, wherein a) below the book block a slip-fold is arranged which is wider than the back of the book block and which is provided with a dry adhesive layer on that side of the surface facing the back of the book block, b) the slip-fold is positioned on a table and is associated to the back of the book block, the table being movable upwards under pressure against the back of the book block so that the slip-fold is pressed onto the back of the book block, and c) heater bars are associated to the projecting lateral sections of the slip-fold at both sides, which heater bars generate a pressure and a heat sealing effect onto the lateral sections of the slip-fold.

19. The device according to claim 18, wherein instead of a strip-type slip-fold a continuous carton folder is provided.

20. The device according to claim 18, wherein a textile web is arranged on a supporting plate, the textile web on its upper side is coated with silicon and supports the slip-folds which are positioned for bonding with the book block.

21. The device according to claim 20, wherein for a continuously operating binding system a continuous slip-fold supplying device is provided which delivers a slip-fold each for the book block in synchronism with the insertion of the book block into the cover.

22. A system for adhesively binding a set of sheets of book blocks, booklets and the like by means of a clamping device for clamping the book block, and an adhesive applying device for transferring adhesive onto the back of the book, in which the clamped book block being positioned between two support elements which are movable horizontally relative to each other and being fastened in their operating position, wherein a) an adhesive pad is arranged underneath the book block which pad is movable in a direction across the plane of the book block and can be lifted against the back of the book block under pressure, b) driving means push the adhesive pad in a combined horizontal and vertical movement in such a manner that the adhesive pad applies adhesive from below onto the back of the book block, and the pad exerts a fulling massaging movement onto the back of the book block resulting in a fanning effect on the back of the book block to present an enlarged surface for the adhesive to be applied, c) said driving means comprise a rolling track along which guide rollers are moved, said guide rollers connected to the adhesive pad.

* * * * *